United States Patent [19]

Stahlecker

[11] 4,186,548

[45] Feb. 5, 1980

[54] BEARING FOR THE SPINNING ROTOR OF AN OPEN-END SPINNING ASSEMBLY

[75] Inventor: Fritz Stahlecker, Josef-Neidhart-Str. 18, 7341 Bad Überkingen, Fed. Rep. of Germany

[73] Assignees: Fritz Stahlecker; Hans Stahlecker, both of Fed. Rep. of Germany

[21] Appl. No.: 890,414

[22] Filed: Apr. 27, 1978

[30] Foreign Application Priority Data

Apr. 14, 1977 [DE] Fed. Rep. of Germany ..... 2716573

[51] Int. Cl.[2] ..... D01H 1/12; D01H 7/12; F16C 1/24; F16C 19/12

[52] U.S. Cl. ..... 57/58.89; 57/92; 57/133; 308/156; 308/169; 308/172

[58] Field of Search ..... 57/58.89–58.95, 57/92, 93, 104, 105, 129, 130, 134, 135, 133; 308/156, 159, 172, 169

[56] References Cited

U.S. PATENT DOCUMENTS

| | | | |
|---|---|---|---|
| 3,779,620 | 12/1973 | Stahlecker | 57/58.89 X |
| 3,807,157 | 4/1974 | Stahlecker | 57/58.89 |
| 3,813,134 | 5/1974 | Wijnant et al. | 308/156 |
| 3,838,560 | 10/1974 | Stahlecker | 57/58.89 |
| 3,951,479 | 4/1976 | Stahlecker | 308/172 |
| 4,022,008 | 5/1977 | Pimiskern et al. | 57/58.89 X |

*Primary Examiner*—John Petrakes
*Attorney, Agent, or Firm*—Craig and Antonelli

[57] ABSTRACT

A bearing arrangement is provided for a rotor shaft of an open-end spinning assembly which includes a ball engageable with the end of the rotor shaft opposite the spinning rotor to axially support the same. The ball is wettable by a lubricant supplied by a wick in contact therewith and is supported in a step bearing housing which includes a retainer member having a cup-shaped portion directly engaging the ball at the side thereof opposite the rotor shaft. In order to transmit operational vibrations from the spinning assembly to the ball so as to improve lubrication of the ball by moving the same, the entire step bearing housing means is supported at a component of the spinning assemby in such a manner that the component vibrations are transmitted to the bearing housing, and thence to the retaining member and ball. With this construction, the bearing housing and the retaining member for the ball itself are constructed substantially compact and rigid since the vibrations are transmitted to the entire bearing housing, rather than to only a ball retainer as in certain prior arrangements.

19 Claims, 3 Drawing Figures

BEARING FOR THE SPINNING ROTOR OF AN OPEN-END SPINNING ASSEMBLY

BACKGROUND AND SUMMARY OF THE INVENTION

The invention relates to a bearing for the spinning rotor of an open-end spinning assembly or the like, whose shaft is supported axially with its end against a ball wet with lubricant, said ball being mounted in a step bearing housing and held against a guide surface in such manner that it can be excited to vibrate.

In a known design of the type described hereinabove (German Auslegschrift No. 23 17 306), a spring-like elastic element serves as a retainer for the ball, said element being disposed in the step bearing housing and supporting the ball directly. The machine vibration causes the ball to move within narrow limits relative to the end of the rotor shaft and also relative to its guide, so that the ball can no longer be held firmly after a prolonged period of operation. The known design produces good results in practice, i.e., low wear. However, there is the danger that in the event of rough treatment or overloading of the spinning rotor resulting from jamming of the latter, the spring-like element will be overloaded and possibly deformed.

An object of the invention is to provide a maximally compact and stable bearing of the type described hereinabove, capable of withstanding rough treatment and overloads and nevertheless making it possible for the ball to move relative to the rotor shaft as a result of the vibrations thereby avoiding jamming. This object is achieved by virtue of the provision that the step bearing housing, provided as a support for the ball, is held by a component of the spinning assembly which is excitable to vibration.

The invention is based, at least in part, on the discovery that it is not absolutely necessary to excite to vibration the part against which the ball rests directly, but rather that the entire step bearing can move in the form of vibrations, since this also results in the relative movement between the ball and the rotor shaft. Movements of this kind resulting from vibration also result in a situation in which the ball moves relative to its holder and its support point changes, so that it can be caused to make rotary movements without difficulty.

In an advantageous embodiment of the invention, provision is made for the step bearing housing to be provided with at least one bracket, said bracket being mounted on a pillow block which accepts a radial bearing supporting the spinning turbine shaft. A bracket of this kind is caused to vibrate, since it was discovered that vibrations cannot be avoided within the radial bearing which are then transmitted to the bracket in the type assemblies contemplated.

In another embodiment of the invention, provision is made for the step bearing housing to be mounted on one wall of a machine frame. In practice, it was discovered as unavoidable for a wall of this kind to be excited to membrane-like oscillations when the machine is operating, when this motion can be used in turn to move the ball relative to the rotor shaft.

In yet another embodiment of the invention, provision is made for a ball retainer provided with a calotte or cup-shaped shell, to which retainer a cage surrounding the ball is fastened. These parts can all easily be made quite strong, since they themselves need not be excited to vibration. This makes it possible to make the ball retainer and/or an insert forming the calotte from a porous sintered material. A material of this kind makes it possible to provide additional lubrication for the ball.

In yet another embodiment of the invention, provision is made for the ball retainer to be in the form of a lever with one end swivelable and lockable with respect to a pin. This makes it possible to ensure a very precise axial alignment of the ball and hence the rotor shaft. Provision can also be made according to contemplated preferred embodiments for the free end of the lever to be brought preferably upward and outward from the step bearing housing and be provided with a locking device. This arrangement makes it possible to perform axial adjustments without opening the step bearing housing.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
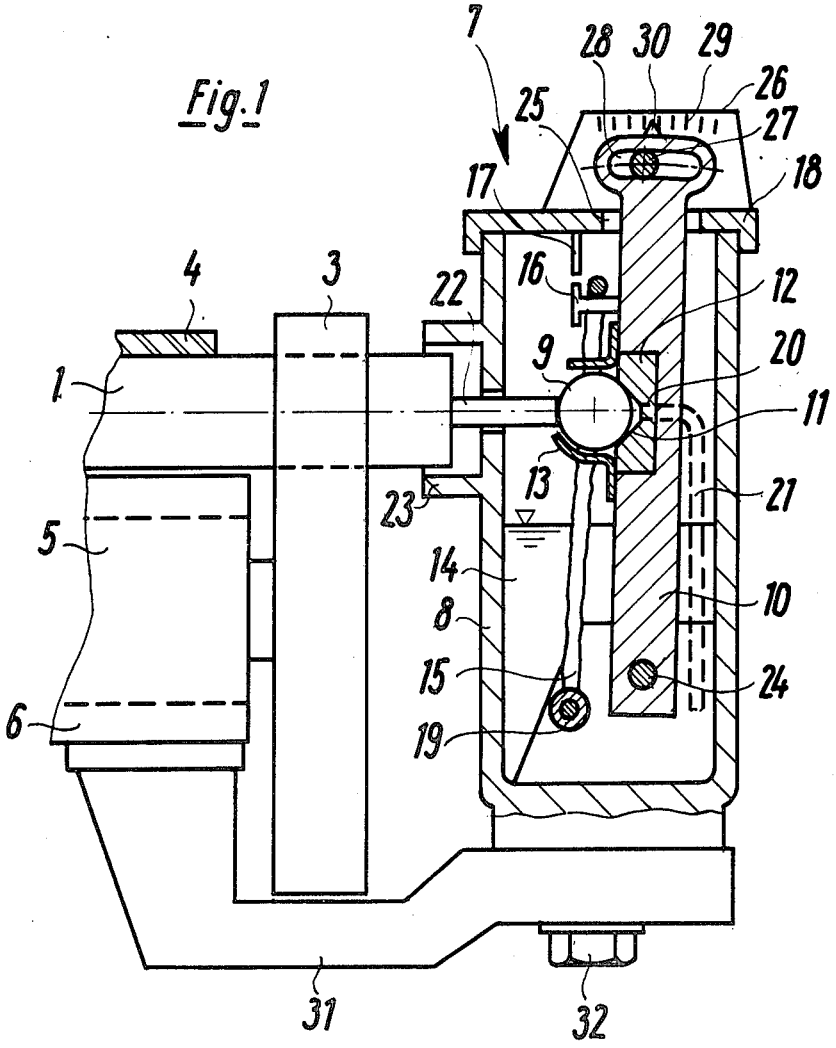
FIG. 1 is a partial cross sectional side view of a bearing for the shaft of a spinning rotor, with a step bearing arrangement constructed in accordance with a preferred embodiment of the invention.

Shaft 1 of a spinning rotor is supported radially in a groove formed by four support disks 3. (The spinning rotor 2 and both sets of support disks 3 are generally similar to those as shown in the FIG. 2 embodiment). Shaft 1 is driven in this groove by a tangential belt 4 (FIG. 2) running directly upon it, said belt 4 holds shaft 1 radially in the groove formed by the support disks 3. A common bearing housing 5 is provided for each two support disks or plates 3 located on the same side of the shaft, said housings being supported in a common pillow block 6.

An axial thrust is exerted upon shaft 1 of the rotor, said thrust being directed away from the rotor and being produced by a tilting of support disks 3 or a transverse direction of travel of tangential belt 4 or the like. This axial force pushes shaft 1 against a step bearing 7. Step bearing 7 is provided with a step bearing housing 8, in which a ball 9 is held by a ball retainer 10 made in the form of a vertically extended lever, said retainer being provided with a calotte or cup-shaped shell 11, as a guide surface for the ball on the side away from shaft 1. The shell 11 is fitted into an insert 12, said insert consisting of a porous material such as sintered ceramic or the like. Ball 9 is also associated with a ball cage 13 disposed on ball retainer 10, said cage insuring that ball 9 cannot leave the vicinity of shell 11, even if the shaft 1 of the spinning rotor is not resting against the ball, in other words if the spinning rotor is removed.

A lubricant bath 14 is provided in the step bearing housing 8, said bath being linked to ball 9 by a wick 15. Wick 15 is made in the form of a continuous ring, which is hung on a pin 16 mounted on retainer 10. A flange 17 prevents the wick from falling off pin 16, said flange being applied against a cover 18 which closes the step bearing housing 8 off from the outside. Ball cage 13 is provided with lateral recesses not shown in the drawing which make it possible for the wick 15 to rest against ball 9. In order to ensure a permanent installation, the wick is provided with lateral recesses not shown in the drawing which make it possible for the wick 15 to rest against ball 9. In order to ensure a permanent installation, the wick is provided with a small weight 19, which pulls it downward and presses it laterally against ball 9. As indicated by the dashed line, insert 12, which constitutes the ball calotte 11, can be provided with a hole 20 which is also brought out through ball retainer 10, through which hole 20, a wick 21, likewise represented by a dashed line, can be brought against ball 9, said wick also being submerged in oil bath 14.

Ball cage 13 surrounds ball 9, leaving a space adjusted so that when rotor shaft 1 is removed, the ball can drop out of the cup 11 only sufficiently far that it can be returned reliably by the horizontal rotor shaft when the latter is replaced firmly in cup 11. The lower part of cage 13 is advantageously made in the form of a cup, so that a certain amount of lubricant can collect there, into which ball 9 falls when rotor shaft 1 is removed. This ensures that when rotor shaft 1 is newly installed, especially good lubrication will result. This lubrication, produced by submersion in a lubricant bath, is also advantageous when the entire spinning machine, which consists of a plurality of spinning assemblies mounted side by side, must be taken apart and reassembled as a whole. The elasticity which is characteristic of tangential belt 4 causes all shafts 1 (in preferred arrangements with a plurality of side by side spinning assemblies whose rotor shafts are driven by the single belt) to move backward slightly when the spinning machine is turned off, so that they are moved away slightly from balls 9. In this way balls 9 can enter the area of the lubricant bath in ball cage 13.

In order to limit the escape of lubricant from step bearing housing 8, provision is made for a replaceable tip 22 to be provided on shaft 1, said tip consisting of an especially hard or hardened material to reduce wear. Step bearing housing 8 is also provided with an annular bead 23 which fits around the rotor shaft which has a larger diameter than tip 22.

Retainer 10, which is made in the form of a lever, is swivelably mounted on pin 24 provided in step bearing housing 8. The free end of the retainer projects through a slot 25 in the cover 18, extending upward and outward from step bearing housing 8. This end is fastened at this point to an extension 26 projecting from cover 18, said projection 26 having an adjustment screw 27. In order to adjust the retainer 10 in a direction axially in respect to rotor shaft 1, the free end is provided with a slot 28, through which adjustment screw 27 projects. A scale 29 is provided on projection 26, and a pointer-like extension 30 of retainer 10 is associated with said scale 29. In this embodiment it is possible to adjust the retainer from outside without opening lubricating bearing housing 8, in such manner that shaft 1 of the spinning rotor and hence the spinning rotor itself can be positioned quite accurately.

In order to prevent the ball from jamming after a long period of operation and consequent contamination, provision is preferably made for conducting vibrations to ball 9, so that it moves relative to shaft 1 or pin 22. This causes the contact point between the ball 9 and pin 22 and also cup 11 to change, causing the ball to make rotational movement. An effort is made to feed vibrations of low amplitude and high frequency to the ball, so that the position of the rotor shaft and hence of the spinning rotor will not change markedly despite the vibration of the ball. In order to transmit the vibrations, produced by existing machine oscillations, to ball 9, the entire step bearing 7 is mounted at the step bearing housing 8 in such manner that ball 9 can vibrate. Step bearing housing 8 is held by at least one bracket 31, to which the bottom of step bearing housing 8 is fastened with one or more bolts 32. Bracket 31 is designed so that it can be excited to natural oscillations by existing machine vibrations. Advantageously, bracket 31 is aligned parallel with rotor shaft 1 and designed so that it undergoes vibrations which cause ball 9 to vibrate in the direction of the axis of shaft 1, said vibrations being of low amplitude and high frequency. In the embodiment shown, bracket 31 is mounted on pillow block 6, said block accepting the bearing 5 of the support disks. In this manner, the vibrations produced by tangential belt 4 and bearings 5 of support plates 3 are transmitted to bracket 31, which is thus caused to oscillate or vibrate.

Figure 2:
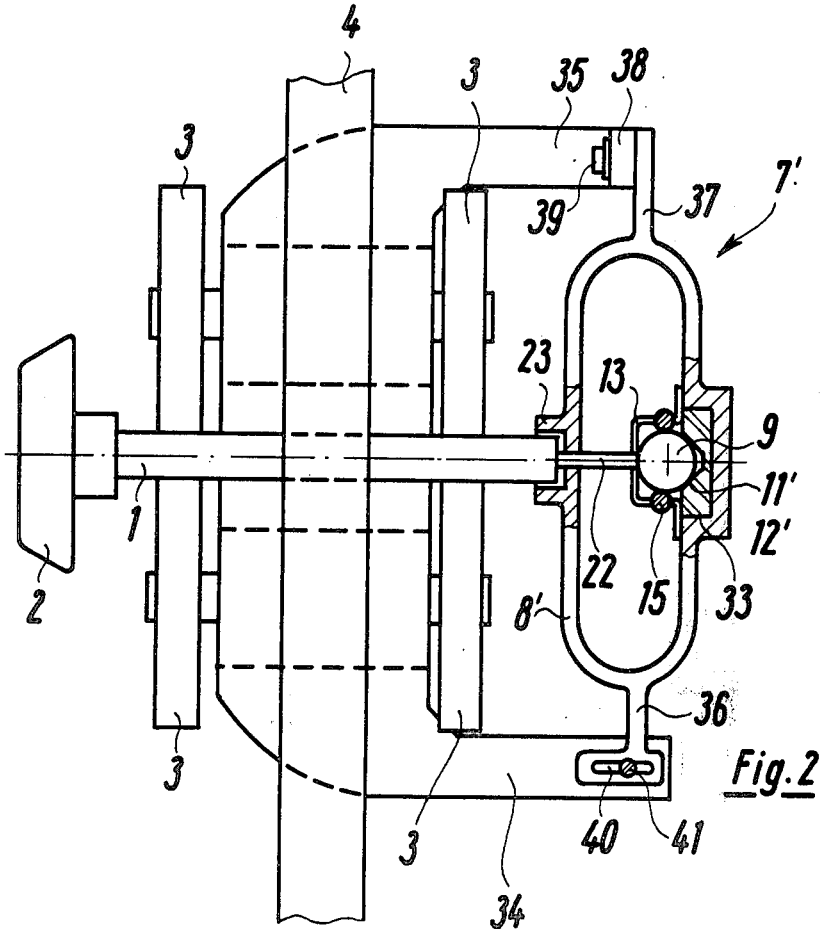
FIG. 2 is a top view of a bearing arrangement, on an enlarged scale, constructed in accordance with another preferred embodiment of the invention.

The embodiment shown in FIG. 2 corresponds in general to the embodiment shown in FIG. 1. In this FIG. 2 embodiment, a spinning rotor 2 with a shaft 1 is likewise supported in a groove formed by four support disks 3, in which groove it is retained by a tangential belt 4 driving it directly. Shaft 1 of spinning rotor 2 is subjected to an axial force which presses it against a step bearing 7'. Step bearing 7' contains a ball 9, against which a pin 22 on shaft 1 rests. On the side which is diametrically opposite pin 22 ball 9 is supported against a cup 11' formed by an insert 12' of sintered material. In this embodiment, insert 12' is mounted directly in a recess 33 in the rear wall of step bearing housing 8'. In the same manner as in the embodiment according to FIG. 1, a cage 13 and a wick 15 are provided for ball 9.

In the embodiment according to FIG. 2, step bearing housing 8' is supported by two brackets 34 and 35, connected to the pillow block of the support plates. Said brackets form a type of frame together with step bearing housing 8'. The parallel position relative to rotor shaft 1 of brackets 34 and 35 and their design causes vibrations to develop in them which have a preferred direction and cause the ball to vibrate at least approximately in the direction of the axis of rotor shaft 1. Step bearing housing 8' is provided with two lateral lugs 36 and 37 which serve to fasten it to brackets 34 and 35. Lug 37 is firmly attached to a flange 38 of bracket 35 by a bolt 39. Adjustment in the axial direction of the rotor shaft is possible on this side by inserting spacers or the like between lug 37 and flange 38. The other lug 36 is provided with a slot 40, parallel to the axis of rotor shaft 1, with an adjustment screw 41 brought out through said slot, said screw being threaded into bracket 34. In order to perform a fine adjustment of step bearing 7 or ball 9 in the axial direction with respect to shaft 1, lug 36 is adjusted. Bracket 35 and/or lug 37 can easily be deformed elastically.

Figure 3:
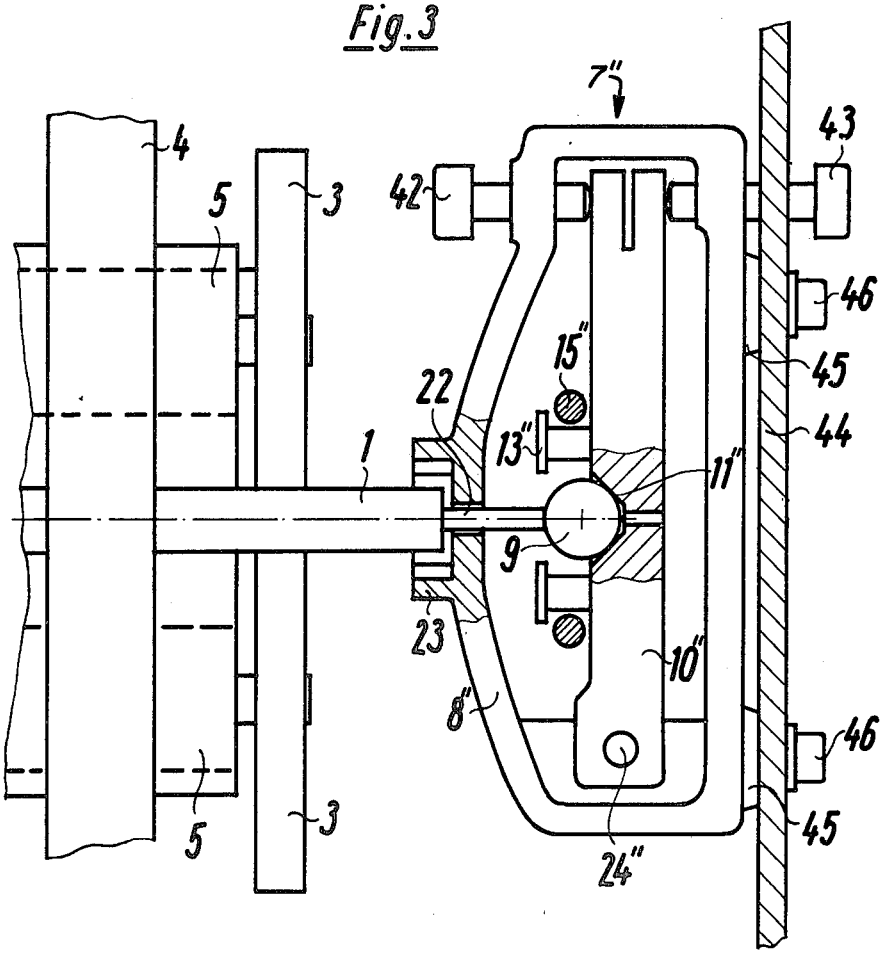
FIG. 3 is a partially cutaway top view of another preferred embodiment of the invention.

In the embodiment shown in FIG. 3, shaft 1 of the spinning rotor is once again supported radially in a groove formed by support disks 3, in which groove it is retained by a tangential belt 4, said belt driving it directly. An axial force is exerted on shaft 1 which forces it against a step bearing 7". Step bearing 7" contains a ball 9, against which a replaceable tip 22 on shaft 1 rests, said tip having a diameter smaller than that of shaft 1.

The ball is guided in calotte or cup 11' diametrically opposite tip 22, said calotte being fitted into a retainer 10''. The ball is surrounded by a cage 13''. It is also associated with a wick 15'' which is submerged in a lubricant bath located in step bearing housing 8, and continuously supplying the ball with lubricant. Retainer 10'' is made in the form of a lever, one end of which is rotatably connected to a pin 24''. The free end of the lever is tensioned between two adjustment screws 42 and 43; turning said screws allows the retainer to be adjusted in such manner that the ball can be shifted axially with respect to the axis of shaft 1. In this embodiment, retainer 10'' is mounted horizontally and is swivelable about a vertical pin 24'', said pin, as in the embodiment shown in FIG. 1, being located in a plane which is perpendicular to the axis of shaft 1.

In order to permit vibration of the ball in this embodiment, resulting in relative movements of ball 9 relative to pin 22 on shaft 1, the step bearing housing 8'' is once again mounted on a component which is caused to vibrate as the open-end spinning machine operates. In this embodiment the housing 8'' is fastened to a vertical wall 44 extending at right angles to the axis or rotor shaft 1, said wall particularly advantageously belonging to a channel running along the length of the machine, said channel surrounding the bearings and drive means of the open-end spinning rotors on one side of the machine. Such a wall 44 undergoes vertical oscillations relative to the wall plane in the manner of a membrane, so that balls 9 move axially with respect to the shaft axis with low amplitude and high frequency when the machine is running. In the embodiment shown in FIG. 3, the rear wall of the step bearing housing 8'' is provided with fastening projections 45 which have tapped holes into which bolts 46 are threaded after passing through wall 44. By adjusting the position of fastening points 45, the frequency and amplitude of vibration of wall 44 and hence that of balls 9 can be influenced.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. Bearing arrangement for a rotor shaft of an open-end spinning assembly or the like of the type having a spinning assembly component which vibrates with rotation of the rotor shaft; said bearing arrangement comprising:

a ball wettable by lubricant and engageable with an end of the rotor shaft to axially support the rotor shaft, step bearing housing means including retainer means for retaining said ball, and supporting means for supporting the entire step bearing housing means on the component of the spinning assembly or the like which vibrates with rotation of the rotor shaft, wherein operational vibrations of said component are transmitted to said ball by way of vibrational movement of said supporting means and the entire step bearing housing means to thereby improve lubrication of said shaft and ball.

2. Bearing arrangement according to claim 1, wherein the step bearing housing means is fastened adjustably with respect to the axial direction of the rotor shaft on the component.

3. Bearing arrangement according to claim 1, wherein a plurality of spinning assemblies are provided on an open-end spinning machine, each spinning assembly of the open-end spinning machine consisting of a plurality of similar spinning assemblies which are respectively equipped with one of said balls, one of said step bearing housing means and supporting means for said one of said step bearing housing means.

4. Bearing arrangement according to claim 1, wherein a plurality of spinning assemblies are provided on an open-end spinning machine, and wherein a common step bearing housing means is provided for a plurality of said spinning assemblies, said step bearing housing means accepting several bearing units which each include one of said balls and retainer means therefor.

5. Bearing arrangement according to claim 1, wherein said component is a pillow block which accepts radial bearing means for radially supporting said shaft, and wherein said supporting means includes bracket means fastened respectively to said pillow block and said step bearing housing means.

6. Bearing arrangement according to claim 5, wherein the bracket means are aligned at least approximately parallel to the axis of the rotor shaft.

7. Bearing arrangement according to claim 1, wherein said component is a wall of a machine frame which carries said spinning assembly or the like, and wherein the supporting means includes means for directly connecting the step bearing housing means on the wall of the machine frame.

8. Bearing arrangement according to claim 7, wherein the wall extends at right angles to the axis of the rotor shaft.

9. Bearing arrangement according to claim 1, wherein the retainer means includes a retainer member mounted in the step bearing housing means, said retainer member being provided with a calotte or cup-shaped part engageable with said ball, and wherein a cage for partially surrounding the ball is fastened to said retainer member.

10. Bearing arrangement according to claim 9, wherein one of said retainer member and an insert constituting the calotte are made of a porous sintered material.

11. Bearing arrangement according to claim 10, wherein the rear wall of the step bearing housing means serves as the retainer member.

12. Bearing arrangement according to claim 9, wherein the rear wall of the step bearing housing means serves as the retainer member.

13. Bearing arrangement according to claim 9, wherein a wick is brought through the retainer member and rests against the side of the ball away from the rotor shaft, said wick being submerged in a lubricant bath.

14. Bearing arrangement according to claim 9, wherein a wick, submerged in a lubricant bath, is placed around the cage, said wick resting against the ball and being made in the form of a continuous loop.

15. Bearing arrangement according to claim 14, wherein the wick is provided with a weight.

16. Bearing arrangement according to claim 9, wherein the cage is provided below the ball with a trough-shaped collecting chamber for lubricant.

17. Bearing arrangement for a rotor shaft of an open-end spinning assembly or the like of the type having a spinning assembly component which vibrates with rotation of the rotor shaft; said bearing arrangement comprising:

a ball wettable by lubricant and engageable with an end of the rotor shaft to axially support the rotor shaft, step bearing housing means including retainer means for retaining said ball, and supporting means for supporting the step bearing housing means on the component of the spinning assembly or the like which vibrates with rotation of the rotor shaft, wherein operational vibrations of said component are transmitted to said ball by way of vibrational movement of said supporting means and the step bearing housing means to thereby improve lubrication of said shaft and ball, wherein the retainer means includes a retainer member mounted in the step bearing housing means, said retainer member being provided with a calotte or cup-shaped part engageable with said ball, and wherein a cage for partially surrounding the ball is fastened to said retainer member, and wherein the retainer member is made in the form of a lever, with one end of said lever swivelable and lockable about a pin.

18. Bearing arrangement according to claim 17, wherein the free end of the lever is brought out of the step bearing housing means preferably upward and is provided there with a locking device.

19. Bearing arrangement according to claim 1, wherein the end of the shaft is provided with a tip which is replaceable and has a smaller diameter than driven portions of said shaft, said tip being introduced into the step bearing housing means and resting against the ball.

* * * * *